US005746016A

United States Patent [19]

Freisinger et al.

[11] Patent Number: 5,746,016

[45] Date of Patent: May 5, 1998

[54] SKI BOOT HAVING WALKING AND SKIING POSITIONS

[75] Inventors: Henry Freisinger; Heinz Wittmann, both of Vienna, Austria

[73] Assignee: HTM Sport- und Freizeitgeraete Aktiengesellschaft, Schwechat, Austria

[21] Appl. No.: 564,082

[22] PCT Filed: Mar. 20, 1995

[86] PCT No.: PCT/EP95/01027

§ 371 Date: Nov. 30, 1995

§ 102(e) Date: Nov. 30, 1995

[87] PCT Pub. No.: WO95/26654

PCT Pub. Date: Oct. 12, 1995

[30] Foreign Application Priority Data

| | | | |
|---|---|---|---|
| Mar. 30, 1994 | [AT] | Austria | 677/94 |
| Apr. 20, 1994 | [AT] | Austria | 822/94 |

[51] Int. Cl.[6] ..... A43B 5/04

[52] U.S. Cl. ..... 36/117.1; 36/117.4

[58] Field of Search ..... 36/50.5, 117.1, 36/117.4, 117.3, 118.5, 118.7, 118.1, 118.2

[56] References Cited

U.S. PATENT DOCUMENTS

| | | | |
|---|---|---|---|
| 4,095,356 | 6/1978 | Robran et al. | 36/105 X |
| 4,665,635 | 5/1987 | Benoit et al. | 36/120 |
| 4,706,393 | 11/1987 | Marxer | 36/50.5 X |
| 4,769,930 | 9/1988 | Morell et al. | 36/120 |
| 4,839,972 | 6/1989 | Pack et al. | 36/47.4 X |
| 4,841,650 | 6/1989 | Dodge et al. | 36/119 |
| 4,901,455 | 2/1990 | Morell et al. | 36/117 |
| 4,905,385 | 3/1990 | Perrissoud | 36/118.5 X |
| 4,932,143 | 6/1990 | Benetti | 36/120 |
| 4,934,075 | 6/1990 | Benetti et al. | 36/120 |
| 5,001,850 | 3/1991 | Mattiuzzo | 36/117 |
| 5,060,403 | 10/1991 | Battistella et al. | 36/118.7 X |
| 5,572,806 | 11/1996 | Osawa | 36/117.4 |

FOREIGN PATENT DOCUMENTS

| | | |
|---|---|---|
| 356 541 | 9/1979 | Austria . |
| 53 470 | 8/1988 | Austria . |
| 86 085 | 5/1990 | Austria . |
| 0 358 599 | 3/1990 | European Pat. Off. . |
| 35 18 233 | 1/1986 | Germany . |
| 36 19 043 | 12/1986 | Germany . |

*Primary Examiner*—B. Dayoan

*Attorney, Agent, or Firm*—Flynn, Thiel, Boutell & Tanis, P.C.

[57] ABSTRACT

A ski boot comprising a shell (1), a movable toe cap (2) and a shaft (3), having a recess (5) in the pivoting area of the toe cap (2), which is closed off by a cover (6) of the toe cap (2). The cover (6) grips under the instep area of the shell (1) and is, viewed in the longitudinal cross section of the ski boot, spherically curved with a radius corresponding to the distance from the imaginary pivot axis of the toe cap (2). At the free edge of the cover (6) and also of the recess (5) on the instep side, there are provided raised beads (7, 8) directed against one another with hooklike formed undercuts, which form-lockingly engage one another in the flat position of the sole (4) and the toe cap (2). A tongue (9) of the cover (6) being in the longitudinal center of the ski boot, is associated with a lock (10, 10') guided transversely with respect to the tongue, which lock as a variable stop releases, limits or prevents a clearance for movement of the toe cap (2). The lock (10, 10') is moved by a Bowden wire (14) against the spring force (15), whereby an operating lever (17, 22, 22') is provided, which additionally fixes the shaft (3) with respect to the shell (1) in the forward position. The locking of the toe cap (2) is done advantageously by a pulling action onto the Bowden wire (14), which is released during unlocking relative to the operating lever (17, 22, 22').

19 Claims, 6 Drawing Sheets

--- LOCKED POSITION

—— UNLOCKED POSITION 1
2
3
4
5
6
7
8
9
11
12
21
22
23
24
25
26

1
2
3
4
5
6
9
10'
11'
12'
14
22'
23'
24'
31
31'
32
33
34

SKI BOOT HAVING WALKING AND SKIING POSITIONS

TECHNICAL FIELD

The invention relates to a ski boot comprising a shell with a sole and a toe cap, which shell holds the foot at least in the instep area, and a shaft surrounding the leg, whereby the shell and toe cap are constructed from one piece of plastic and are pivotally connected with one another by the sole, a recess is provided in the shell rearwardly of the toe cap and extends through the ski boot essentially over its entire width to define the pivoting range of the toe cap, and a cover projecting beyond the rearward edge of the cap to cover the recess and can be moved during pivoting of the toe cap under the instep area of the shell.

A ski boot is, on the one hand, supposed to form an essentially rigid unit in connection with the ski, whereby the toe cap is held in the flat position and the shaft in a forward position; on the other hand, a flexing of the sole is supposed to be possible during walking. A toe cap, which is pivotal relative to the shell, is used for this purpose. When the shell of the ski boot is designed in one piece of plastic, the jointed connection with the toe cap is created through the sole, which in the pivoting range can be bent through a transverse groove.

BASIC STATE OF THE ART

A sports boot is known from PCT WO 92/19117, which includes a pivotal toe cap which for the purpose of a relative mobility with respect to the shell, is hinged with a spacing in the form of a gaplike recess through the sole to the shell. This recess is laterally bridged on both sides by a cover, which moves under the shell during walking. The important, center part of the recess is covered by a deformable insert. The insert is compressed when the toe cap is pivoted in and is expanded when the flat position is reached. The moldable material, like for example a rubber sponge, is highly stressed by coldness, moisture and by a continuous change of the shape so that it tears and consequently sealing problems can result, in particular at the connecting areas of the toe cap on the one side and of the shell on the other side. An operating mechanism in the shell blocks the toe cap during skiing. This blocking can be done through a linkage by means of a trigger on the side of the heel inserted through a binding element, like for example, the heel automatic mechanism.

Furthermore, the AT-PS 356 541 discloses a ski boot formed in one piece and having an inner reinforcing insert. The reinforcing insert is arranged in the area of the sole and consists of two parts connected by a hinge. This ski boot has an elasticity in the toe area, which elasticity depends on the particular design. An individual toe cap can only be locked at the reinforcing insert.

The DE-A1-24 46 066 describes a front-foot heel shell for a ski boot, in which a partial shell receiving the toe-ball portion can be pivoted and locked relative to the remaining shell about a transverse axis positioned on or close to the sole, whereby the dividing edges of the partial shell and of the remaining shell face one another and lie outside of the sole overlapping one another. The free end edge of the cover grips under the shell and where the edging of the shell defines the recess, in at least one area of the free end edge of the cover there are provided bars directed against one another.

Finally, AT-B-379 731 discloses a ski boot having a lower part holding the foot and an upper part holding the leg and is designed as a shaft, the parts are connected by a bellows, whereby the stiffness of the bellows can be varied in the area of its front side by inserting a reinforcing element between the folds of the bellows. The reinforcing element is designed like a serrated slat, the teeth of which engage in the expanded position of the bellows between the folds, preferably designed with a trapezoidal cross section.

DISCLOSURE OF THE INVENTION

The invention has the goal of improving the sealing of a ski boot having a toe cap movable with respect to the shell. This is achieved in a ski boot of the above-mentioned type by the cover, viewed in the longitudinal cross section of the ski boot, being spherically curved and having a curvature, starting from the longitudinal center plane, decreases with an increasing distance toward both sides in parallel planes, whereby the curvature radius corresponds preferably approximately at a distance of the cover from the pivot axis of the sole, in particular to the imaginary connection of the sole-side ends of the recess. The cover not only continues the toe cap below the gap of the recess forming the free space for the pivoting, but is bent like a spherical joint in addition to the arc shape. The surface is similar to a strip of an ellipsoid. The surfaces are positioned closely to one another during each movement. The radius of the curvature decreases with the distance from the longitudinal center plane of the ski boot. The radius of the curvature disappears completely at the side parts. It is particularly advantageous when at least in one area of the free end edge of the cover extends under the shell and at least one edge of the edging of the shell defining the recess are both provided with raised beads having undercuts. The raised beads are directed against one another form-lockingly engaged to one another in the flat position of the sole. The raised beads engage clawlike in this important position. When the undercuts are U-shaped and the complementary raised beads have such projections, then key surfaces run on one another and self-centering takes place. Furthermore, a very good sealing can be achieved in the flat position. The engaging elements have the further effect that the sole cannot be stretched beyond the horizontal plane. Thus, an end stop results at the largest permissible recess or gap width. The shell and toe cap are in the flat position rigidly coupled with one another through the form-locking connection of the engaging undercuts.

A particular embodiment provides that on the toe cap, in particular in its longitudinal center, there is provided a rotary lock changeable about a vertical axis, the rotary lock gripping for the position fixation of the toe cap in the flat position of the sole over the recess, and is supported with one front surface on the shell, and can be rotated out of the area of the recess for the release of the pivotability of the toe cap. The rotary lock can have an eccentric shape rotatably supported on the side of the shell or cap and grips over the recess for the position fixation of the cap in the flat position. A constant diameter is particularly well suited for this purpose. A mechanism for the toe-cap locking or release is arranged covered and protectively not visible from the outside, and is characterized in such a manner that both a contact surface and an opposing control surface of a lock, which is guided transversely with respect to the longitudinal axis of the ski boot in the shell, are provided on the cover, in particular on a tongue projecting in the longitudinal center of the ski boot from the cover. The control surface in the direction of movement of the lock has preferably two sections positioned stepped with respect to one another and pass over into one another through an incline, whereby the one section when moving onto the contact surface locks the toe cap in its flat position and the other section is set back to the extent of the clearance for movement of the toe cap. Depending on the lock position there exists, limitedly exists, or does not exist a degree of freedom of the toe cap. The lock can be moved against spring force through a handle, however, in an advantageous manner also through a Bowden wire in the heel area of the shell being guided to an operating lever, whereby the latter also advantageously controls an elastic locking pin for locking of shell and shaft. The toe-cap fixation in the flat position is advantageous during skiing. At the same time, however, the forward position for fixation of the shaft in the inclined position with respect to the shell is also of importance for the downhill skiing. This can be achieved with the one operating lever controlling the Bowden wire and the elastic self-engaging pin. A practical addition results when the rotary lock carries position markings, for example the colors red and green, on its upper side with each one depending on the position of the rotary lock or the lock is opposite a viewing window in the instep area of the shell. A practical design is characterized by an approximately U-shaped bar being connected to the operating lever. The U-shaped bar laterally encloses and grips under a covering tongue and the Bowden wire is suspended below the covering tongue into the bar, the wire is guided in a guideway in a base plate supporting the sleeve tube of the Bowden wire. It is advantageous when the section of the lock fixing the toe cap in the flat position is designed as a sloped surface, therefore, when moving onto the contact surface of the toe cap transmits, for example through the force of the spring, an initial tension onto the toe cap, whereby hook-shaped undercuts of the bars rest pressure-loaded against one another. In order to guarantee the locking by the force of the lever through the Bowden wire, it is provided that the Bowden wire is connected or suspended at the end of the lock, to the initially closest section set back for unlocking of the toe cap, whereby the lock with its incline and when the section following thereafter moves onto the contact surface of the toe cap upon a pull by the Bowden wire and presses the toe cap into the flat position. However, it is also possible to connect or suspend the Bowden wire at the end of the lock, from which the section set back for unlocking of the toe cap is remote, whereby the lock with its inclines and with the section following thereafter moves with the Bowden wire being relaxed under the action of a relaxing spring onto the contact surface of the toe cap and locks the toe cap in the flat position.

BRIEF DESCRIPTION OF THE DRAWINGS

Exemplary embodiments of the invention are schematically illustrated in the drawings.

THE PREFERRED EMBODIMENT OF THE INVENTION

Figures 1, 1A:
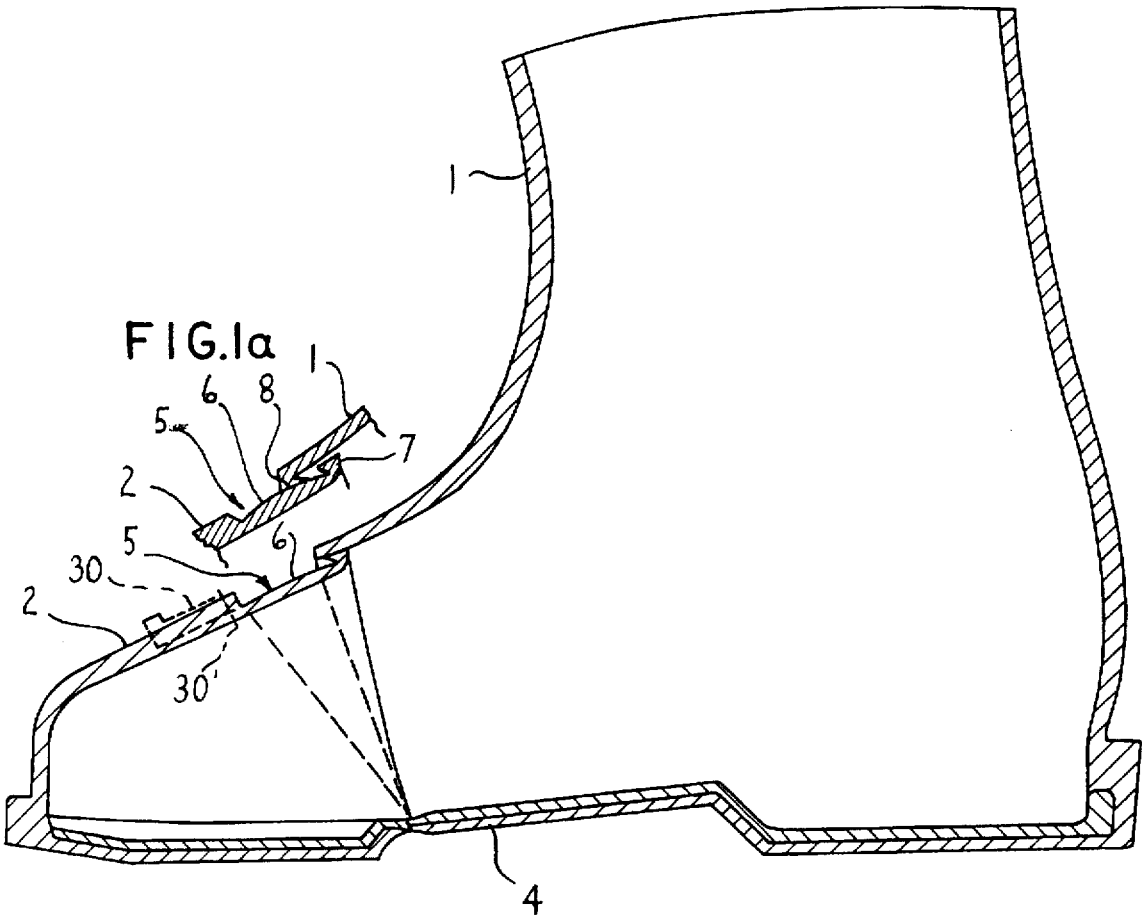
FIG. 1 is a longitudinal cross-sectional view of a ski boot with a flat sole.
FIG. 1*a* shows a detail during walking with the ski boot.
Figure 1B:
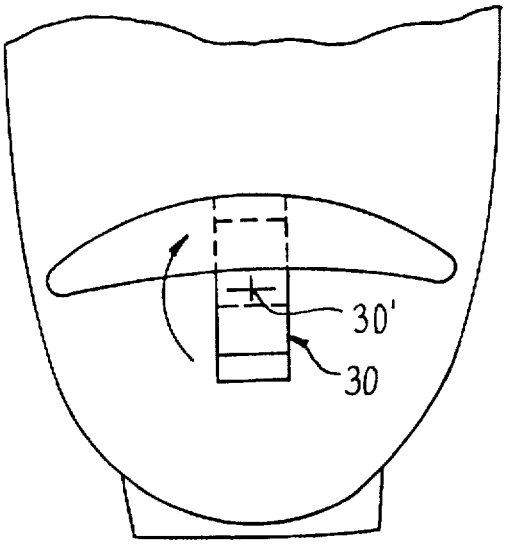
FIG. 1*b* is a top view showing the rotary lock.
Figures 2, 2A:
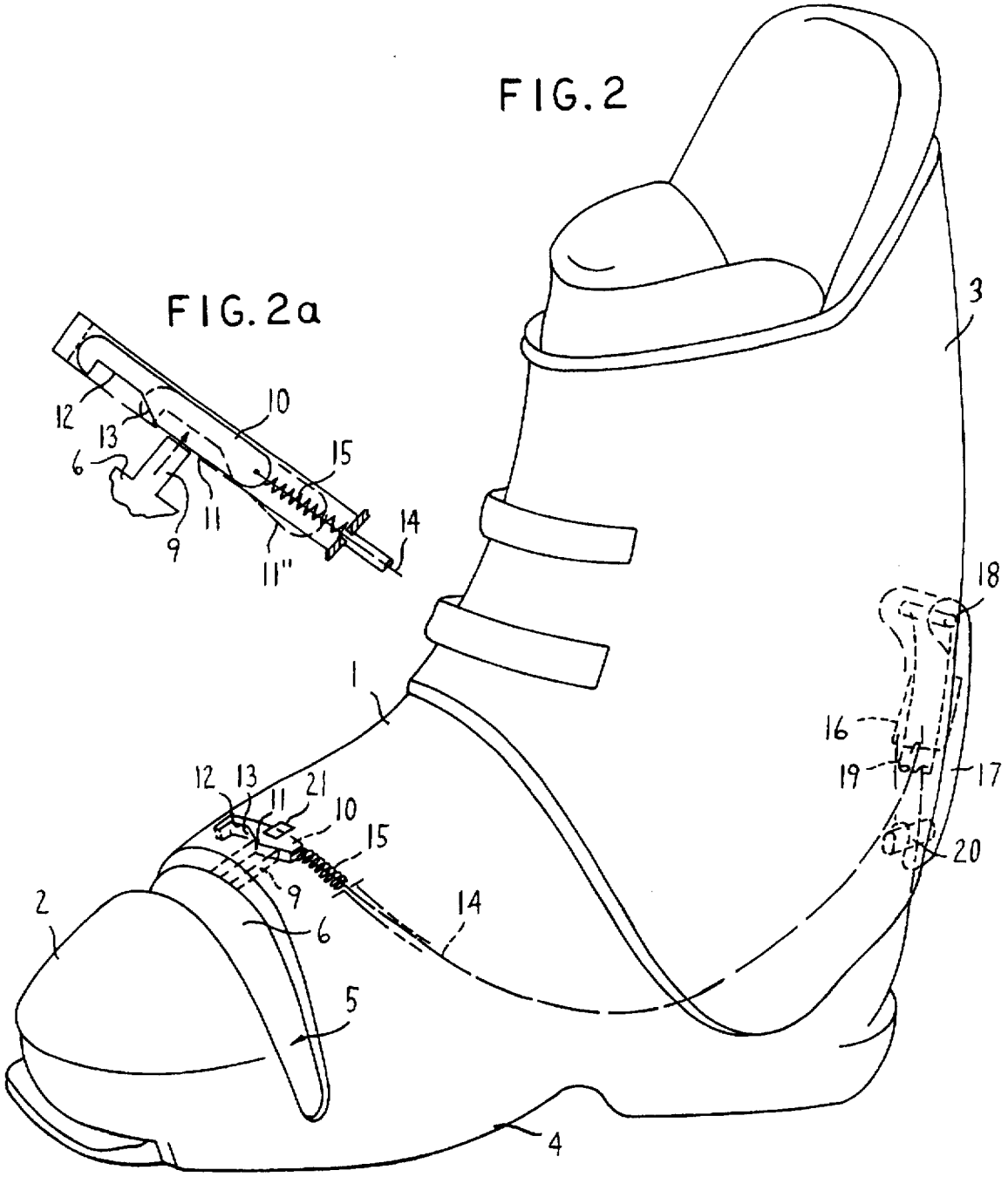
FIG. 2 is an oblique view of a toe-cap locking mechanism with an operating lever and simultaneous forward-position fixing means.
FIG. 2*a* shows a detail, namely, the locking arrangement enlarged in a top view.

A ski boot includes according to FIGS. 1 to 5 a shell 1 with a pivotally hinged toe cap 2 and with an also pivotal shaft 3 (FIG. 2). A sole 4 is part of the shell 1 and transfers over into the toe cap 2. The shell 1, sole 4 and toe cap 2 are in the exemplary embodiment according to FIG. 1 formed in one piece of plastic. A recess 5 exists between the toe cap 2 and the shell 1, which recess enables a pivoting of the toe cap 2. FIG. 2 shows the design of the recess in a front view. The sole 4 can have a groove in the area of the imaginary connection between the ends of the recess 5, which groove represents a defined axis of rotation for the toe cap 2. The elasticity of the plastic is in many cases sufficient for bending the sole 4 even without any special structural measures.

A cover 6 rearwardly follows the toe cap 2, which cover grips under the recess 5 and moves during pivoting of the toe cap 2, for example during walking, under the instep area of the shell 1. In order to achieve a good seal, the outer surface of the cover 6 is spherically arched. In the longitudinal cross-sectional view according to FIG. 1 showing an arc on the surface of the cover 6 with a radius corresponding with the distance from the (imaginary) axis of rotation of the toe cap 2. Raised beads 7, 8, which are directed against one another, are provided on the free edges of the cover 6 and on the rearward edge of the recess 5. These raised beads carry hooklike undercuts with sloped surfaces (key surfaces) running on one another so that in the flat position of the sole 4 (FIG. 1) there is obtained a form-locking tight connection. According to FIG. 1*a*, the spherically curved surface of the cover 6 slides during the bending of the toe cap 2—resting on the raised beads 8—under the instep area of the shell 1. The contact surface of the raised beads 8 can be adjusted to the curvature of the surface of the cover 6. Dirt, in particular snow, is removed during walking from the recess 5 by the inclined front surfaces in the transition area of the toe cap 2 to the cover 6 and at the front side of the raised beads 8. The raised beads 7, 8 with their form-locking connections end in the transition area between the shell upper part and the shell side surfaces, however, they can also be pulled down to the end of the recess 5. The toe cap 2 is supposed to be movable during walking, however, the ski boot is supposed to hold the foot essentially rigid during skiing. The toe cap 2 carries, according to FIGS. 2 and 2*a*, a tongue 9 projecting from the cover 5 in order to fix its position in the flat position of the sole, which tongue is guided under the instep area of the shell 1, and if necessary, into a channel of the shell 1. This tongue 9 participates in the movements of the toe cap 2 as an essentially linear movement. The tongue 9 has a bearing surface on its front side. A lock 10 is guided transversely with respect to the direction of movement of the tongue in the shell 1 or in a lock housing stationarily arranged in the shell 1. The lock 10 carries laterally two control surfaces 11, 12 that lay stepped with respect to one another and which pass over into one another through an incline 13. When the lock 10 is positioned in such a manner shown in FIGS. 2 and 2*a*, the control surface 11 lies then directly on the bearing surface of the tongue 9 and prevents any type of movement of the toe cap 2. However, when the lock 10 is being moved so that—as illustrated by dashed lines in FIG. 2*a*—the set-back control surface 12 of the lock 10 aligns with the bearing surface of the tongue 9, then it is possible to pivot the toe cap 2 until the set-back lock stop becomes active. The lock 9 can also be designed such that it deals only with the incline 13 and the control surface 11 so that the tongue 9 is either blocked off by the lock 10 or, when the lock 10 is pulled back, the free space is available. The incline 13 of the lock 10 has the purpose to move during the locking operation, forcing the toe cap 2 into the flat position of the sole 4.

FIG. 2 shows the movement of the lock 10 through a Bowden wire 14. The lock 10 is moved through a spring 15 into the illustrated blocking position of the toe cap 2 and can be pulled back against the action of the spring 15. The Bowden wire 14 is for this purpose suspended in a bar 16 of an upwardly pivotal operating lever 17. When a pull is applied to the Bowden wire 14 by the operating lever 17, then the lock 10 reaches its release position. The return is handled by the spring 15 as soon as the pulling action stops. A covering tongue 19 is mounted on the same axis 18 below the operating lever 17. This tongue protects and covers, when the operating lever 17 is pivoted upwardly, the point of suspension of the Bowden wire 14 on the bar 16. Finally a locking pin 20 engages and disengages the shell 1 or the shaft 3 through the operating lever 17. When the operating lever 17 is mounted on the shell 1, the locking pin 20 engages an opening in the shaft 3 so that its position (forward position for the skier) can be fixed. When the operating lever 17 is mounted on the shaft 3, then the locking pin 20 extends into an opening of the shell 1. In every case, the shell 1 and the shaft 3 are locked. This locking of the shaft 3 in the forward position goes hand in hand with the locking of the toe cap 2 in the flat position of the sole 4.

Figures 3, 3A:
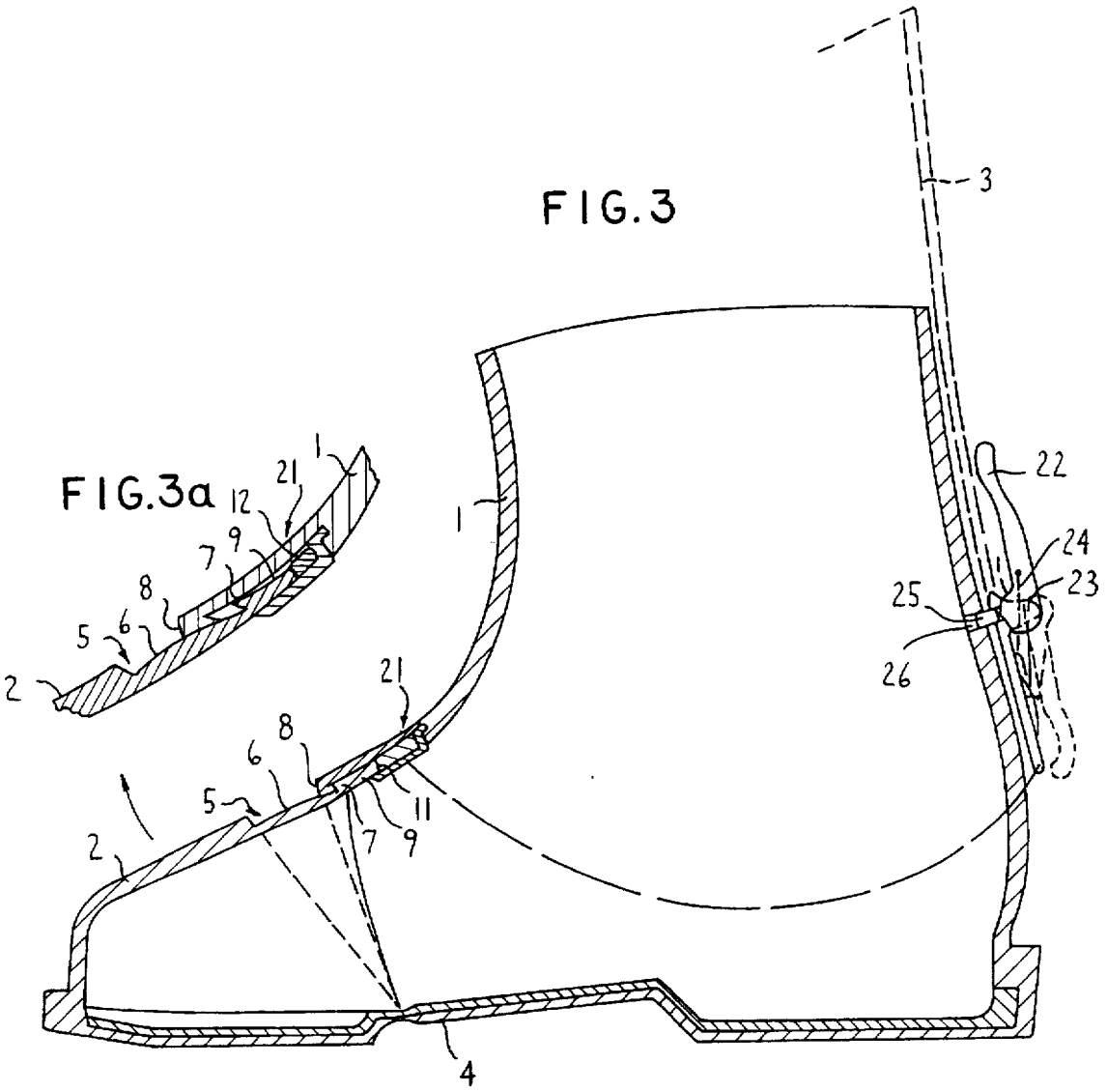
FIG. 3 is a longitudinal cross-sectional view of a ski boot with a toe-cap fixing means according to FIG. 2 in locking position, however, with a different operating lever.
FIG. 3*a* is an enlarged detail of FIG. 3 of the toe-cap fixing means in the release position and FIGS. 4 and 4*a* and 5 and 5*a* show alternative embodiments for FIGS. 2 and 2*a* and 3 and 3*a*.

FIGS. 3 and 3*a* show the toe-cap locking mechanism according to FIGS. 2 and 2*a* in a cross-sectional view. The tongue 9 is shown in FIG. 3 at the surface 11 of the lock 10 and cannot move. A pulling apart is not possible because the hooklike undercuts of the raised beads 7, 8 engage one another. When the control surface 11 is designed as a sloped surface 11", it applies pressure onto the tongue 9 through the action of the spring 15 so that the hooklike undercut raised beads 7, 8 engage one another with an initial tension. This supports the sealing action of the cover 5 with respect to the shell 1 in the area of the raised beads 7, 8, which have to meet very high demands especially during skiing, for example, in powder snow. The control surface 12 is in FIG. 3*a* opposite the tongue 9 and forms a stop at the end of the pivoting range of the toe cap 2.

A viewing window 21 is provided in the shell 1 above the lock 10, through the window the respective locking position can be viewed. The upper side of the lock 10 can be colored green in the area of the control surface 11 or 11" (for skiing) and red in the area of the control surface 12 (for walking).

FIG. 3 shows again the Bowden wire 14, however, cooperating with a slightly differently designed operating lever 22. The latter is rotatably supported about an axis of rotation 23 on the shaft 3 or on the shell 1. A U-shaped bar 24 is hinged to the operating lever 22, to which the Bowden wire 14 is attached. The upwardly pivoted position of the operating lever 22 causes a pulling force on the lock 10, which moves against the spring force into the position according to FIG. 3. The downwardly pivoted position of the operating lever 22, which position is shown by a dashed line, permits the spring of the lock 10 to become active so that the situation according to FIG. 3*a* results.

The operating lever 22 is designed in an eccentric shape in the area of the axis of rotation and presses an elastic locking pin 25 against the ski boot. The locking pin 25 snaps into the opening 26 of the shell 1 as soon as the opening 26 is in alignment with the locking-pin axis. This is the case in the forward position of the shaft 3 with respect to the shell 1. FIG. 1 shows furthermore in dashed lines a rotary lock 30 on the toe cap 2, which rotary lock can be rotated about an axis of rotation 30' into the recess and can be supported with its front surface on the shell 1 in the area of the raised beads 8 for fixing the position of the toe cap 2. This particularly simple design is advantageous when only the toe cap 2 is supposed to be released and fixed, however, an operating lever does not exist for the fixation of the shaft.

Figures 4, 4A:
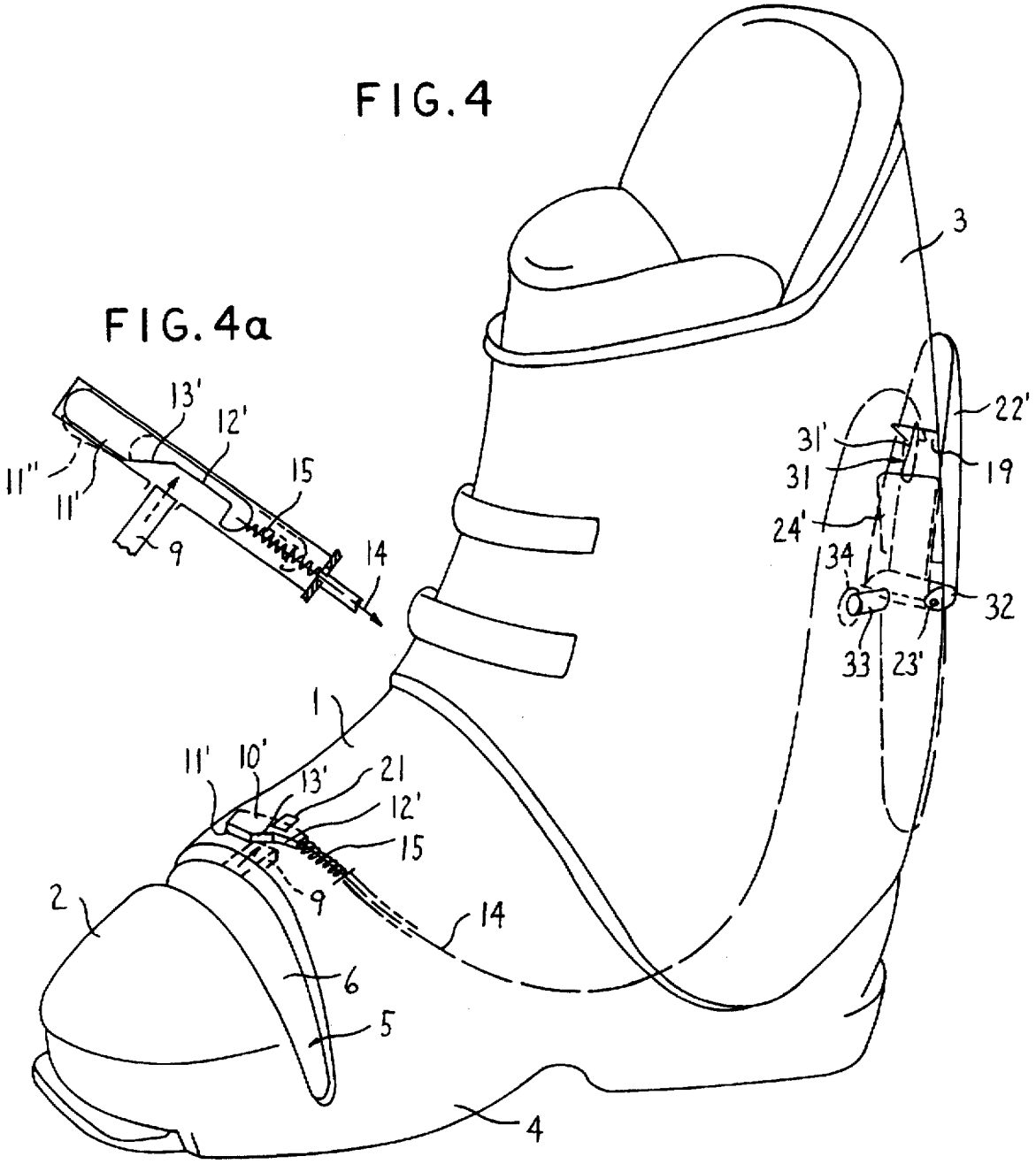

FIGS. 4 and 4*a* and 5 and 5*a* are similar to FIGS. 2, 2*a* and 3, 3*a*, whereby as an alternative the Bowden wire 14 pulls the lock 10', when moving the operating lever 22' from the position illustrated in FIG. 4 downwardly to the blocking position of the toe cap 2. The toe cap 2 was unlocked in FIGS. 2, 2*a* through the pulling action of the Bowden wire 14, and the locking was essentially caused by the force of the spring 15.

The lock 10', which is guided movably transversely to the tongue 9 of the toe cap 2, has according to FIG. 4 two sections 11' and 12', which transfer into one another through an incline 13'. The section 11' projects with respect to the section 12' and holds the toe cap 2 in the rigid flat position by resting or pressing on the front surface of the tongue 9. FIGS. 4 and 4*a* show the unlocking position, in which the lock 10' is with its section 12' opposite the tongue 9 and releases a clearance for movement of the toe cap 2. FIG. 4*a* shows in detail the lock 10' with respect to the tongue 9.

By moving the operating lever 22' from the position shown in full lines in FIG. 4 downwardly, a pulling force transmitted by the bar 24' is applied to the Bowden wire 14 so that the lock 10' is pulled to the right against the force of the spring 15 in FIGS. 4 or 4*a*. This causes the section 11' to be moved blockingly in front of the tongue 9. When the toe cap 2 was bent upwardly the incline 13' moves onto the tongue 9 and presses the toe cap 2 into the flat position, as illustrated in FIG. 4.

The connection between the Bowden wire 14 and the bar 24' of the operating lever 22 is created by a hook 31 at the end of the Bowden wire, the free leg 31' of the hook is longer than its path of movement during a change-over of the operating lever 22'. A spacing between the operating lever 22' and the Bowden wire 14 is achieved, and it is possible to pivot the operating lever 22' from the blocking position upwardly into the release position of the toe-cap movement even if the spring 15 may possibly, at that instance, not be able to overcome the friction contact between the lock section 11' and the front surface of the tongue 9. By extending the toe cap 2 the tongue 9 lifts off from the section 11', which causes the lock 10' to rush into the release position, according to FIG. 4, through the force of the spring 15 with the operating lever 22' having already been moved. The bar 24' remains always within the hook 30. An unthreading from the hook 30 is counteracted by the long leg 31. The U-shaped recess in the cover tongue 19 serves to guide the hook 30.

The release position is here illustrated between the Bowden wire 14 and the operating lever 22'. It can, however, also exist between the Bowden wire 14 and the lock 10' in such a manner that the end of the Bowden wire 14 on the side of the lock is not fixedly connected to the lock 10', but instead during the change-over of the operating lever 22 into its release position lifts one top end of the Bowden wire 14 from a carrier surface on the side of the lock and steps back should the spring force 15 for a short time or temporarily not be sufficient with respect to the frictional resistance of the lock to move the lock 10' into the release position of the toe-cap movement.

A window 21 lies opposite the lock 10', which is guided within the shell 1, which window through color markings on the lock 10' identifies its position through the window.

Figures 5, 5A:
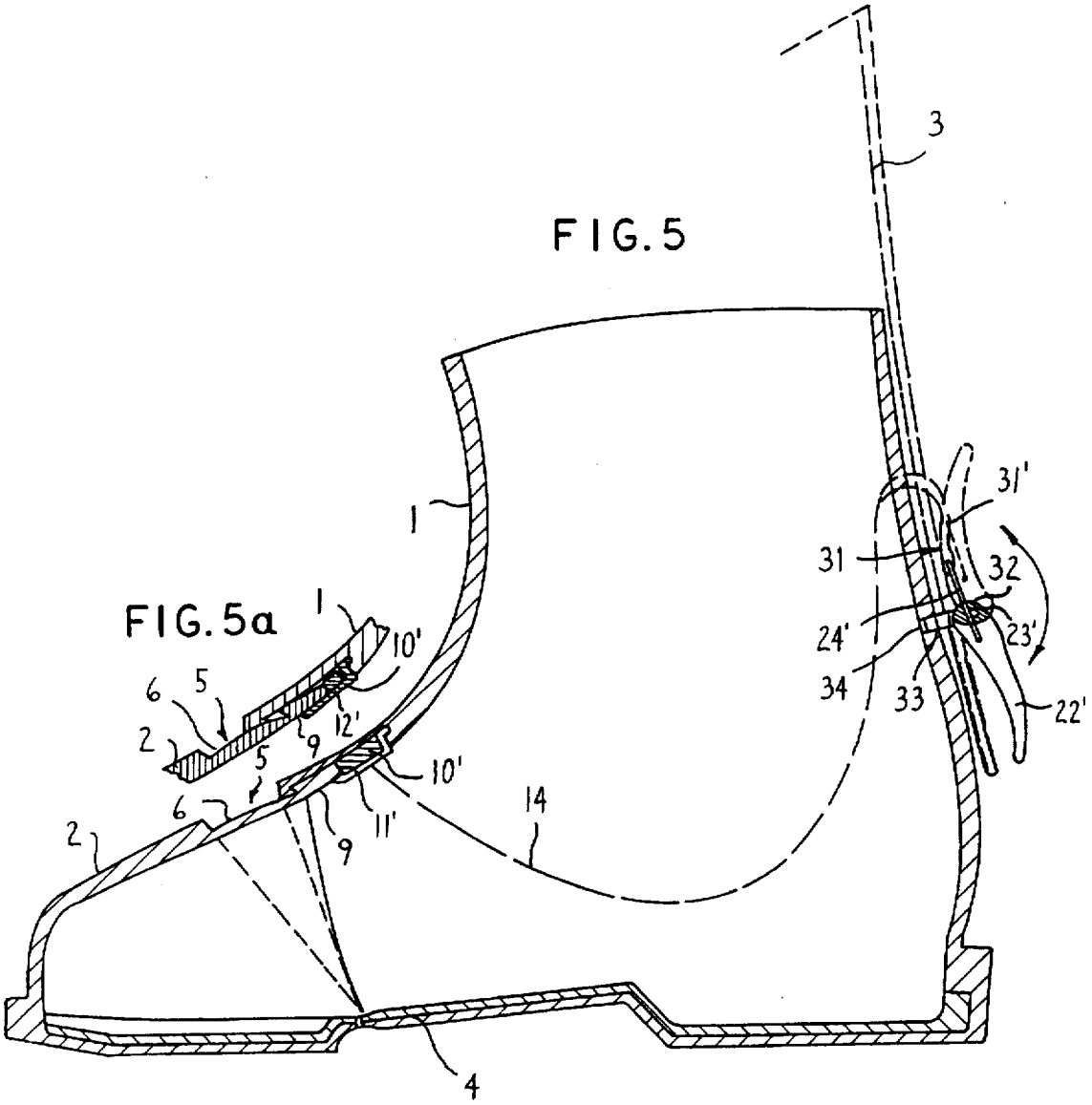

FIG. 4*a* illustrates again in detail, the locking mechanism, in a flat position as it is described above. The lock 10' shows in full lines the release position of the toe cap 2, in which the tongue 9 has a clearance for movement in the arrow direction up to the stop at the section 12'. When the Bowden wire 14 is pulled by the operating lever 22', the lock 10' moves in FIG. 4*a* to the right and the incline 13' presses the toe cap 2 into the flat position. The section 11' fixes this position. When the section 11' has a sloped surface 13', the toe cap 2 is pressed forwardly also during locking and the undercuts of the raised beads 7, 8 are, for example in the elastic area, pressed against one another. The operating lever 22' has, besides the pulling action on the Bowden wire 14, in addition the function of locking of shaft 3 and shell 1 of the ski boot, simultaneously with the position fixation of the toe cap 2 in the flat position. The operating lever 22' has an eccentric shape 32 around its axis of rotation 23', which eccentric shape controls an elastic locking pin 33. The eccentric shape 32 is positioned in such a manner, in the lever position of FIG. 4 shown in full lines, that the locking pin 33 retreats from an opening 34 in the shell 1. When the operating lever 22' is traversed downwardly, the eccentric shape 32 presses the locking pin 33 into the opening 34, as this is illustrated in FIG. 5. Thus the shell 33 and the shaft 1 are rigidly connected.

FIGS. 5 and 5*a* are cross-sectional views of the exemplary embodiment according to FIGS. 4 and 4*a*, whereby FIG. 5 in contrast to FIG. 4 as mentioned, represents the locked state of the toe cap 2, whereas the detail according to FIG. 5*a* shows the release position, in which the toe cap 2 is pivotal until the tongue 9 rests on the section 12'. FIG. 5 shows that the bar 24', in the upwardly pivoted position of the operating lever 22' with the Bowden wire 14 being relieved, continues to lie within the hook 31, when the hook 31 through the spring 15 at the other end of the Bowden wire 14 does not follow the movement of the bar 24'.

It is also mentioned that the locking pin 33 follows the eccentric shape 32 in its guideway in the shaft 3 in its axial direction, that, however, a spring element is interpositioned so that the locking pin 33 in the operating-lever position according to FIG. 5 is initially tensioned by spring force against the shell 1 and engages the opening 34 as soon as it is in alignment with the locking pin 33.

We claim:

1. A ski boots comprising a shell defining two sides and having a sole, a toe cap, and a recess, the shell being adapted to hold at least an instep area of a foot, a shaft surrounding a leg, the shell and toe cap being constructed in one piece of plastic and being pivotally connected with one another by the sole, the recess being provided in the shell following the toe cap and extending through an entire width of the shell, the recess defining a pivoting range of the toe cap, and a cover projecting over the edge of the toe cap, the cover gripping the toe cap adjacent the recess and being movable during pivoting of the toe cap under the instep area of the shell, the cover being spherically curved in a longitudinal cross-section of the ski boot and having a curvature starting from a longitudinal center plane decreasing with an increasing distance toward the two sides in parallel planes, a radius of the curvature corresponding approximately to a distance of the cover from the pivot axis of the sole.

2. The ski boot according to claim 1, wherein the recess is defined by an edge in the shell, the cover has a free edge, the free edge gripping under the recess, and at least in one area of the free edge of the cover and of the edge of the shell raised beads are provided with undercuts and are directed against one another form-lockingly engaging one another in a flat position of the sole.

3. The ski boot according to claim 1, wherein a rotary lock rotatable about a vertical axis is provided on the toe cap, the rotary lock grips for fixing the position of the toe cap in the flat position of the sole over the recess and one front surface of the rotary lock being supported on the shell, and the rotary lock being rotated out of the area of the recess to release the toe cap to pivot.

4. The ski boot according to claim 1, wherein means for locking the toe cap in a fixed position flatly with respect to the sole is provided on the cover, the locking means having a control surface movable transversely with respect to the longitudinal axis of the shell, a contact surface opposite the control surface is provided on the cover, the control surface in the direction of movement of the locking means has two sections positioned stepped with respect to one another and are joined to one another through an incline, one section when contacting the contact surface locks the toe cap the flat position and the second section is set back providing clearance for movement of the toe cap.

5. The ski boot according to claim 4, wherein a spring means biases the locking means so that the second section is aligned with the contact surface, a wire is connected to the locking means, an operating lever is mounted on a rear area of one of the shaft and shell and is connected to the wire, the operating lever being adapted to move the locking means against a spring force of the spring means through the wire.

6. The ski boot according to claim 3, wherein a viewing window is positioned in the instep area of the shell, and the rotary lock has position markings on an upper side thereof, each position marking depending on the position of the rotary lock is opposite the viewing window.

7. The ski boot according to claim 5, wherein an approximately U-shaped bar is connected to the operating lever, the bar receiving the wire therein, the bar having a baseplate receiving the wire therethrough, the wire being enclosed by a sleeve tube, the sleeve tube being supported on the base plate, and a covering tongue is provided to enclose the bar.

8. The ski boot according to claim 4, wherein the one section of the locking means fixing the toe cap in the flat position has a sloped surface, the sloped surface when moving onto the contact surface transmits an initial tension onto the toe cap so that hook-shaped undercuts of the raised beads rest pressure-loaded against one another.

9. The ski boot according to claim 5, wherein the wire is connected at an end of the lock closest the second section set back for unlocking the toe cap allowing the toe cap to pivot, whereby the locking means with the incline and the one section following after the incline moves onto the contact surface after a pull by the wire and the locking means presses the toe cap into the flat position.

10. The ski boot according to claim 5, wherein the wire is connected to an end of the locking means remote from the second section set back for unlocking of the toe cap so that the locking means with the incline and the one section following after the incline moves with the wire under the biasing of the spring onto the contact surface and locks the toe cap in the flat position.

11. The ski boot according to claim 7, wherein the wire is suspended in the bar by means of a hook, and one of the depth of the hook and the length of free leg of the hook is greater than a path of movement of the bar during a position chance of the operating lever.

12. The ski boot according to claim 11, wherein the cover tongue in a front-side, bent area has an approximately U-shaped recess, in which the hook with the leg is guided.

13. The ski boot according to claim 4, wherein the locking means is guided in a lock housing inserted in the shell, and the lock housing has a projection in an area opposite the tongue, the projection engages an undercut of the shell for form-locking position fixation of the lock housing in the shell.

14. The ski boot according to claim 1, wherein the distance corresponding to the radius of curvature is from the axis of rotation of the toe cap to the cover.

15. The ski boot according to claim 4, wherein said contact surface is provided on a tongue positioned on the cover, the tongue extending along the longitudinal center of the shell.

16. The ski boot according to claim 5, wherein a locking pin is connected to the operating lever, the locking pin being received in an opening in one of the shaft and shell to fix the shaft and shell to each other.

17. The ski boot according to claim 5, wherein a viewing window is positioned in the instep area of the shell, and the locking means has position markings thereon aligned with the viewing window, one of the position markings being viewable in the viewing window when the toe cap is in the flat position and another of the position markings being viewable in the viewing window when toe cap is movable relative to the shell.

18. A ski boot, comprising a shaft for receiving a leg of a skier and a shell for enclosing a foot of a skier defining an inner and outer side of the ski boot and having a sole, an instep, and a toe cap, the shell being constructed of one piece of structural material, the toe cap being connected to the sole and being pivotable relative to the instep through a pivotable range about a pivot axis, the toe cap having a recess therein extending from the inner side to the outer side, the recess defining the pivotable range of the toe cap, the instep having a curved cover projecting over the recess, the cover having a radius of curvature with a maximum at a longitudinal center of the shell decreasing toward the inner and outer sides, the radius of curvature approximately corresponding to a distance of the cover from the pivot axis, and a means for locking the toe cap relative to the shell essentially preventing pivoting of the toe cap.

19. The ski boot according to claim 18, wherein the shell has means for sealing the instep and toe cap in a form-locking tight connection when the locking means prevents pivoting of the toe cap.

* * * * *

UNITED STATES PATENT AND TRADEMARK OFFICE

CERTIFICATE OF CORRECTION

PATENT NO. : 5 746 016

DATED : May 5, 1998

INVENTOR(S) : Henry FREISINGER et al

It is certified that error appears in the above-indentified patent and that said Letters Patent is hereby corrected as shown below:

Column 7, line 44; change "boots" to ---boot,---.

Column 7, lines 63-67; change "at least in one area of the free edge of the cover and of the edge of the shell raised beads are provided with undercuts and are directed against one another form-lockingly engaging one another in a flat position of the sole" to ---raised beads are provided with undercuts and are directed against one another form-lockingly engaging one another in a flat position of the sole at least in one area of the free edge of the cover and of the edge of the shell---.

Column 8, line 17; after "cap" insert ---in---.

Column 8, line 62; change "chance" to ---change---.

Signed and Sealed this

FourthDay of August, 1998

Bruce Lehman

*Attest:*

BRUCE LEHMAN

*Attesting Officer*

*Commissioner of Patents and Trademarks*